US006144014A

United States Patent [19]

Dodier et al.

[11] Patent Number: 6,144,014

[45] Date of Patent: Nov. 7, 2000

[54] ELECTRIC COMPOSITION COMPRISING SMALL CERAMIC PLATE CARRYING A SCREENED RESISTIVE AND/OR CONDUCTIVE PATTERN

[75] Inventors: Philippo Dodier, Sainte Foy les Lyon; Thierry Gailhard, Chaponnay, both of France

[73] Assignee: SEB S.A., Ecully, France

[21] Appl. No.: 09/381,699

[22] PCT Filed: Dec. 15, 1998

[86] PCT No.: PCT/FR98/02737

§ 371 Date: Sep. 23, 1999

§ 102(e) Date: Sep. 23, 1999

[87] PCT Pub. No.: WO99/38359

PCT Pub. Date: Jul. 29, 1999

[30] Foreign Application Priority Data

Jan. 23, 1998 [FR] France ..... 98 00944

[51] Int. Cl.[7] ..... H05B 3/30; H05B 3/06; D06F 75/00

[52] U.S. Cl. ..... 219/256; 219/254; 219/543; 219/541; 38/82; 38/77.1

[58] Field of Search ..... 219/256, 254, 219/255, 245, 541, 542, 544, 543, 466.1; 392/404; 38/77.1–77.9, 74, 82

[56] References Cited

U.S. PATENT DOCUMENTS

| | | | |
|---|---|---|---|
| 729,369 | 5/1903 | Loewenthal | 219/254 |
| 3,007,026 | 10/1961 | Woodling | 219/254 |
| 4,713,529 | 12/1987 | Melanson et al. | 219/256 |
| 4,730,102 | 3/1988 | Melanson . | |
| 5,475,199 | 12/1995 | Buchanan | 219/243 |

FOREIGN PATENT DOCUMENTS

| | | | |
|---|---|---|---|
| 158 779 | 10/1985 | European Pat. Off. . | |
| 2 189 562 | 1/1974 | France . | |
| 2691723 | 12/1993 | France . | |
| 127993 | 8/1959 | U.S.S.R. | 219/254 |
| 1085784 | 10/1967 | United Kingdom . | |
| 2272226 | 5/1994 | United Kingdom | 38/77.83 |
| 2330402 | 4/1999 | United Kingdom . | |
| 93/02533 | 2/1993 | WIPO . | |
| 96/17405 | 6/1996 | WIPO . | |

OTHER PUBLICATIONS

Japanese Patents Gazette, Week 8810, Derwent Publications, AN88–067443, XP002097440 and JP 63 021100, Jan. 28, 1988, abstract.

*Primary Examiner*—John A. Jeffery
*Attorney, Agent, or Firm*—Pillsbury Madison & Sutro

[57] ABSTRACT

An electrical component having a small electrically isolating ceramic plate carrying on one of its faces a screened resistive and/or conductive pattern, the other face being in contact with a metal plate intended to be heated or the temperature of which is to be measured. The pattern has at least one metallized extremity to establish an electrical connection with a conductive wire. The conductive wire is soldered onto the metallized extremity and the small ceramic plate is entirely covered by a metal cover the peripheral edges of which surround the small plate and are fixed in a watertight manner to the metal plate by a resin. The lateral wall of the cover has at least one opening for the passage of the conductive wire or wires, the opening or openings being blocked by a sealing resin.

13 Claims, 3 Drawing Sheets

ELECTRIC COMPOSITION COMPRISING SMALL CERAMIC PLATE CARRYING A SCREENED RESISTIVE AND/OR CONDUCTIVE PATTERN

BACKGROUND OF THE INVENTION

The present invention concerns an electric component comprising a small electrically isolating ceramic plate carrying on one of its faces a screened resistive and/or conductive pattern, the other face of this small ceramic plate being in contact with another plate intended to be heated and the temperature of which it is desired to measure.

The invention is also concerned with a household electric steam appliance and in particular a steam iron having an electric component of the above type.

In an appliance of the above type, one of the problems to be resolved is to assure electrical connection and electrical isolation of the electrical component and of its connector in a durable fashion in a hot and humid environment, that is a temperature comprised between 250° and 300° C. and a humidity level of 100%.

The above component is most often fixed on the plate whose temperature is to be raised by a cement (for example, silicone) layer assuring a mechanical gripping and heat transfer.

The electrical connection can be achieved by an association of cemented contacts and wires or by metal contacts maintained under pressure against the resistive and/or conductive patterns.

Such a construction presents the drawback that under the combined effects of temperature and moisture, electrical contacts become detached or oxidized; in addition, by condensing on the circuit, the moisture provokes current leakages at different points thereof.

BRIEF SUMMARY OF THE INVENTION

The object of the present invention is to remedy the above drawbacks.

The invention is thus directed to an electrical component comprising a small electrically isolating ceramic plate carrying on one of its faces a screened resistive and/or conductive pattern, the other face of this small ceramic plate being in contact with a metal plate intended to be heated or whose temperature is to be measured, the pattern having at least one metallized end to establish an electric connection with a conductive wire.

According to the invention, this electrical component is characterized in that the conductive wire is soldered onto said metallized end and in that the small ceramic plate is entirely covered by a metal cover whose peripheral edges surround said small plate and are fixed in sealed manner to the metal plate by means of a resin, the lateral wall of said cover having at least one opening for the passage of the conductive wire or wires, said opening or openings being blocked by a sealing resin.

The totality of the above arrangements permits an electric component according to the invention to withstand the temperature and humidity conditions referred to above.

According to an advantageous version of the invention, said cover has a parallelepiped form whose lateral faces have a height greater than the thickness of the small ceramic plate in a manner to leave a space between the pattern and the upper wall of the cover.

Preferably, the conductive wire soldered onto said metallized end is covered by an epoxy resin base cement.

Advantageously, the small ceramic plate is cemented onto the metal plate by means of a cement layer.

According to a preferred version of the invention, the cement layer overflows to the periphery of the small ceramic plate in a manner to simultaneously assure cementing of the peripheral edge of the cover on the metal plate.

Advantageously, said cement layer is sufficiently thick to assure watertightness of the openings or of the conductive wires.

According to another preferred version of the invention, said space situated between the upper wall of the cover and the resistive and/or conductive pattern is filled by a resin, this resin itself assuring the fixation of the cover onto the metal plate and the blocking of the opening or openings for passage of the conductive wire or wires.

In a preferred application of the invention, said metal plate forms a part of the soleplate of a steam pressing iron.

The invention is equally concerned with a household electrical appliance in particular a steam pressing iron comprising an electric component of the above type.

BRIEF DESCRIPTION OF THE SEVERAL VIEWS OF THE DRAWINGS

Other particularities and advantages of the invention will also appear in the description herebelow.

On the attached drawings given by way of non-limiting examples.

DETAILED DESCRIPTION OF THE INVENTION

Figure 3:
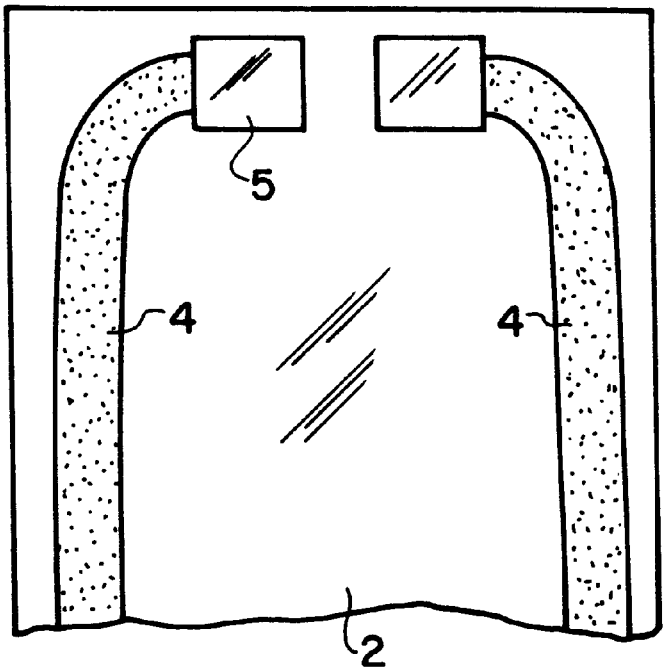
FIG. 3 is a partial plan view of the small ceramic plate showing the resistive and/or conductive pattern and the metallized extremities thereof.

In the embodiment shown in the attached figures, electrical component 1 comprises a small electrically isolating plate 2 of ceramic carrying on one of its faces (see FIG. 3) a screened resistive and/or conductive pattern 4. The other face of this small ceramic plate 2 is in contact with a metal plate 3 (see FIG. 1) intended to be heated and the temperature of which it is desired to measure.

Resistive and/or conductive pattern 4 is composed of at least one metallized extremity 5 (two in the example of FIG. 3), to establish an electrical connection with a conductive wire 6.

According to the invention, conductive wire 6 is soldered onto metallized extremity 5. Moreover, small ceramic plate 2 is entirely covered by a metal cover 8 of which the peripheral edges **8*b* surround small plate 2 and are fixed in a watertight fashion to metal plate 3 by means of a resin or cement. On the other hand, lateral wall 8*a* of cover 8 has at least one opening 9 (see FIGS. 2 and 4) for the passage of the conductive wire or wires 6**, the opening or openings being blocked by a waterproofing resin.

Figure 1:
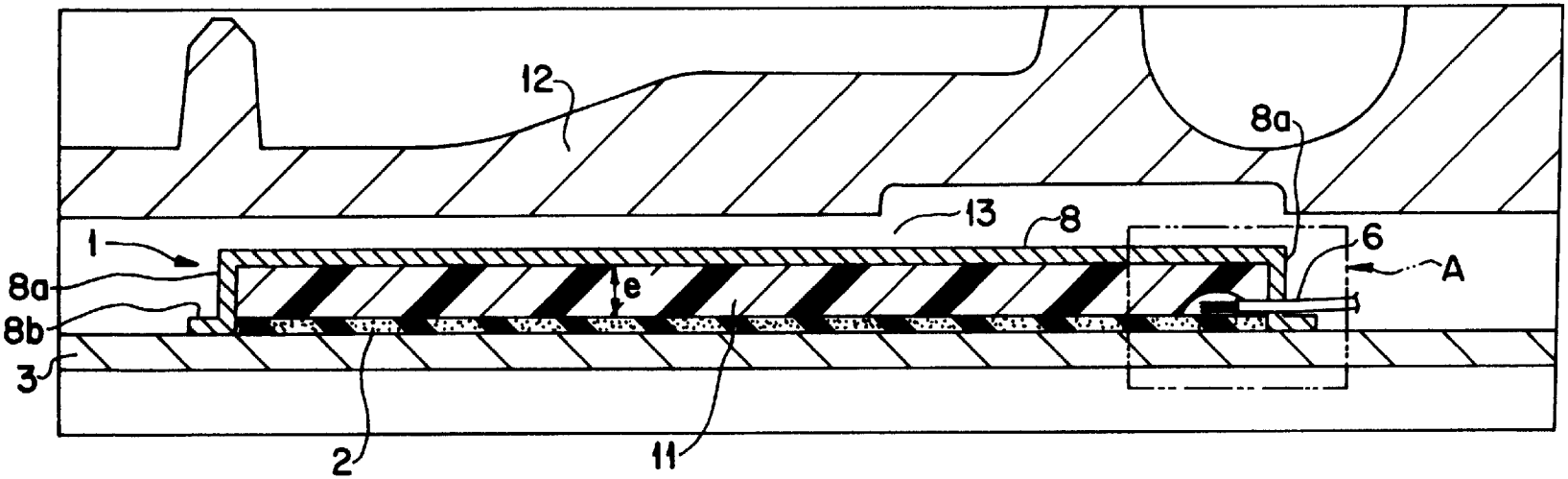
FIG. 1 is a partial longitudinal cross-sectional view of a steam iron soleplate having an electrical component according to the invention.

It is seen in FIG. 1 that cover 8 has a parallelepiped form of which the lateral faces 8*a* have a height greater than the thickness of small ceramic plate 2, in a manner to leave a space e between screened resistive and/or conductive pattern 4 and the upper wall of cover 8.

Figure 2:
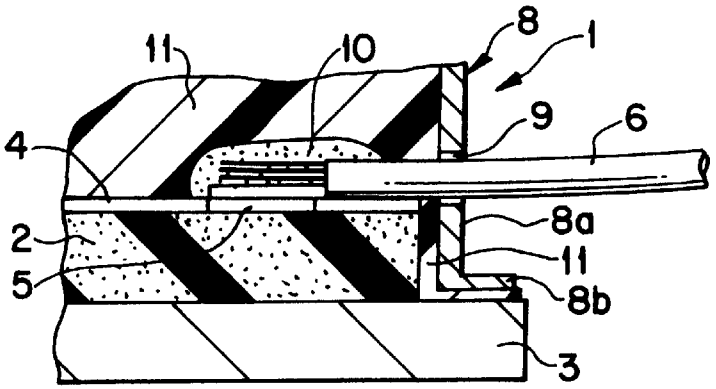
FIG. 2 is a view to a larger scale of the detail A of FIG. 1.
Figure 4:
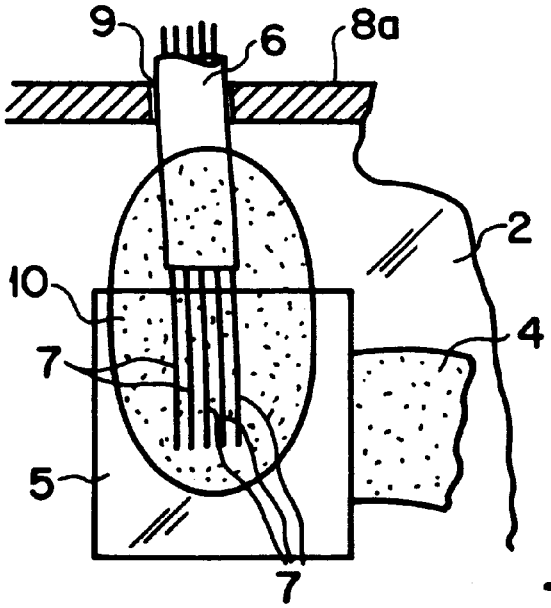
FIG. 4 is a partial plan view showing the electrical connection of the conductive wire on the metallized extremity of the resistive and/or conductive pattern.

On the other hand, in the example represented in FIGS. 2 and 4, conductive wire 6 soldered to metallized extremity 5 is covered by a cement 10 for example having an epoxy resin base.

Preferably, the metallized extremity or extremities 5 are metallized by means of a silver layer.

According to an advantageous arrangement of the invention not shown in the figures, small ceramic plate 2 is cemented onto metal plate 3 by means of a cement layer.

According to a preferred version of the invention, the above-cited layer of cement overflows to the periphery of small ceramic plate 2 in a manner to simultaneously assure cementing of the peripheral edges 8*b* of cover 8 onto metal plate 3.

Advantageously, said layer of cement is sufficiently thick to assure watertightness of opening or openings 9 for conductive wire or wires 6.

According to another preferred version of the invention, such as shown in FIGS. 1 and 2, space $^{e}$ situated between the upper wall of cover 8 and resistive and/or conductive pattern 4 is filled by a resin 11. This resin 11 itself assures attachment of cover 8 onto metal plate 3 and blocking of opening or openings 9 for the passage of conductive wire or wires 6. As shown in FIG. 2, a layer of resin 11 is present between peripheral edge 8*b* of cover 8 as well as between small ceramic plate 2 and lateral faces 8*a* of cover 8. By way of a variation, resin 11 covers small ceramic plate 2 but does not entirely fill space e.

According to an advantageous variant, not shown in the figures, resin 11 equally covers conductive wire 6 soldered to metal extremity 5.

In a simplified embodiment, none of the resin flows into space e, and peripheral edge 8*b* of cover 8 is simply cemented by means of a resin to plate 3.

Preferably, metal plate 3 is of aluminum.

Figure 5:
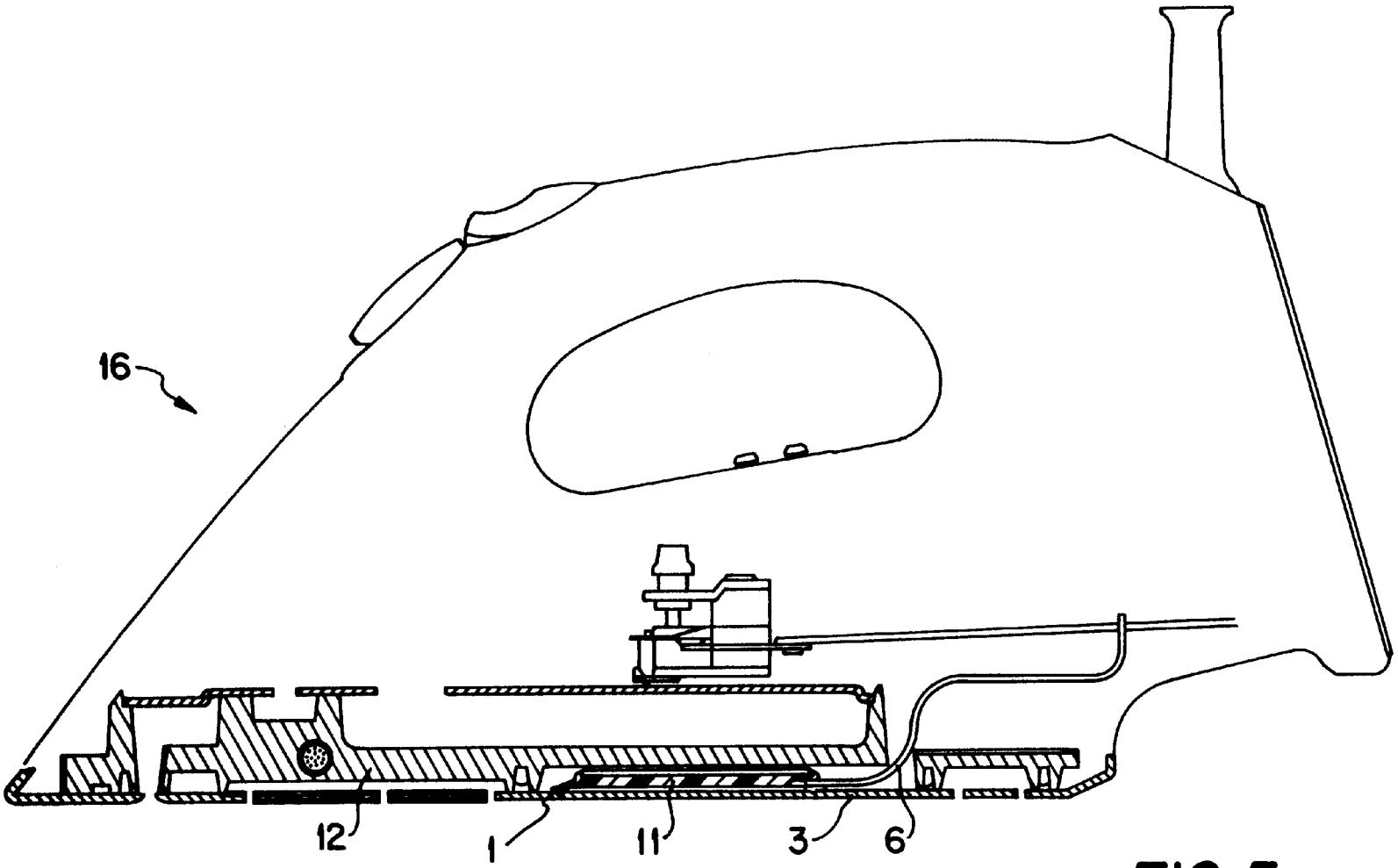
FIG. 5 is a side elevational view, partially in cross section, showing an electrical steam iron equipped with an electrical component according to the invention.

In the example of FIG. 1, metal plate 3 forms a part of the heating soleplate of a steam pressing iron 16, as shown in FIG. 5.

This heating soleplate is constituted by a molded element 12 of aluminum in which is coated a tubular electrical heating resistance (not shown).

To this molded element 12 is fixed a cap constituted by aluminum plate 3.

A cavity 13 is arranged between element 12 and plate 3.

Electrical component 1 described above fixed to plate 3 is situated in cavity 13.

Resistive and/or conductive pattern 4 screened onto small ceramic plate 2 can be utilized to heat a determined zone of cap 3 of the soleplate of the pressing iron.

In another application, this resistive and/or conductive pattern 4 can be utilized to measure with precision the temperature of cap 3.

In this application, the resistance variation of resistive and/or conductive pattern 4 is transformed, for example by means of a Wheatstone bridge, into an electrical signal which is converted into units of temperature.

Tests have shown that electrical component 1 which has just been described resisted remarkably well various thermal, electrical and mechanical stresses to which steam pressing irons are subjected.

Of course, the invention is not limited to the example that has just been described and numerous modifications can be made thereto without departing from the framework of the invention. For example, the cover can have a non-parallellepiped form.

POSSIBILITY OF INDUSTRIAL APPLICATION

The invention finds its application in the technical field of household electrical steam appliances and in particular steam pressing irons.

What is claimed is:

1. Electrical component (1) comprising a small electrically isolating ceramic plate (2) carrying on one of its faces a screened resistive and/or conductive pattern (4), the other face of said small ceramic plate (2) being in contact with a metal plate (3) intended to be heated or the temperature of which is to be measured, the pattern (4) having at least one metallized extremity (5) to establish an electrical connection with a conductive wire (6), characterized in that the conductive wire (6) is soldered onto said metallized extremity (5) and in that the small ceramic plate (2) is entirely covered by a metal cover (8) the peripheral edges (8*b*) of which surround said small plate (2) and are fixed in a watertight manner to the metal plate (3) by means of a resin, the lateral wall (8*a*) of said cover (8) having at least one opening (9) for the passage of the conductive wire or wires (6), the opening or openings being blocked by a sealing resin.

2. Component according to claim 1, characterized in that said cover (8) has a parallelepiped form the lateral faces (8*a*) of which present a height greater than the thickness of the small ceramic plate (2), in a manner to leave a space (e) between the pattern (4) and the upper wall of the cover (8).

3. Component according to claim 2, characterized in that the small ceramic plate (2) is cemented onto the metal plate (3) by means of a cement layer.

4. Component according to claim 2, characterized in that the cement layer overflows to the periphery of the small ceramic plate (2) in a manner to simultaneously assure cementing of the peripheral edges (8*b*) of the cover (8) onto the metal plate (3).

5. Component according to claim 4, characterized in that said cement layer is sufficiently thick to assure watertightness of the opening or openings (9) of the conductive wire or wires (6).

6. Component according to claim 5, characterized in that said space (e) situated between the upper wall of the cover (8) and the resistive and/or conductive pattern (4) is filled at least partially by a resin (11), this resin (11) itself assuring attachment of the cover (8) onto the metal plate (3) and blocking of the opening or openings (9) for the passage of the conductive wire or wires (6).

7. Component according to one of claim 2, characterized in that the metallized extremity (5) of the conductive wire or wires (6) is metallized by means of a silver layer.

8. Component according to claim 2, characterized in that the conductive wire (6) soldered to said metallized extremity (5) is covered by a cement (10) having an epoxy resin base.

9. Component according to claim 1, characterized in that said metal plate (3) is aluminum.

10. Component according to claim 1, characterized in that said metal plate (3) forms part of a soleplate of a steam pressing iron.

11. Household electrical steam appliance comprising an electrical component (1) according to claim 1.

12. Household electrical steam appliance according to claim 11, characterized in that it is constituted by a pressing iron.

13. Pressing iron according to claim 12, comprising a heating soleplate constituted by a molded element (12) of aluminum in which is coated a tubular electrical heating resistance, element (12) to which is fixed an aluminum plate, a cavity (13) being arranged between said element (12) and said plate (3) and an electrical component (1), according to claim 1, fixed to said plate (3) being situated in said cavity (13).

* * * * *